United States Patent [19]

Fifolt et al.

[11] Patent Number: 4,528,109

[45] Date of Patent: Jul. 9, 1985

[54] NON-FLAMMABLE HYDRAULIC FLUIDS

[75] Inventors: Michael J. Fifolt, Grand Island; John Forcucci, Niagara Falls, both of N.Y.

[73] Assignee: Occidental Chemical Corporation, Niagara Falls, N.Y.

[21] Appl. No.: 519,940

[22] Filed: Aug. 3, 1983

[51] Int. Cl.[3] ..... C09K 15/20; C10M 1/20; C10M 1/26; C10M 3/24

[52] U.S. Cl. ..... 252/78.1; 252/52 A; 252/56 D; 252/56 R; 252/56 S; 252/58; 252/73; 252/77; 252/404

[58] Field of Search ..... 252/58, 56 S, 73, 78.1, 252/77, 404, 79 F, 56 D, 56 R, 52 A

[56] References Cited

U.S. PATENT DOCUMENTS

| | | | |
|---|---|---|---|
| 2,205,183 | 3/1938 | Woodhouse | 252/51.5 A |
| 2,462,694 | 10/1946 | Walker | 252/78.1 |
| 2,528,348 | 10/1950 | Denison et al. | 252/78.1 |
| 2,550,760 | 5/1951 | Bishop | 252/56 S |
| 2,583,588 | 1/1952 | Mosteller | 252/78.1 |
| 3,492,233 | 1/1970 | Hepplewhite et al. | 252/73 |
| 3,524,816 | 8/1970 | Hagemeyer et al. | 252/73 |

*Primary Examiner*—John E. Kittle
*Assistant Examiner*—Mukund J. Shah
*Attorney, Agent, or Firm*—James F. Tao; William G. Gosz

[57] ABSTRACT

Non-flammable hydraulic fluids which are particularly useful for replacing existing hydraulic fluids in hydraulic systems employing acrylonitrile-butadiene rubber and Viton or PNF seals are disclosed. The non-flammable hydraulic fluids of the present invention comprise a fluorinated chlorotrifluoroethylene oil, an aliphatic ester, a liquid polyester or polyether, a hydrocarbon oil having a low wax content, and a phenolic antioxidant. The chlorotrifluoroethylene oil is present in an amount of at least about 75% by volume of the hydraulic fluid. Such hydraulic fluids are useful in applications where the flammability of existing fluids poses a significant risk of combustion or explosion due to the possibility of leakage of the fluid from the hydraulic system.

7 Claims, No Drawings

NON-FLAMMABLE HYDRAULIC FLUIDS

BACKGROUND OF THE INVENTION

The present invention relates to improved hydraulic fluids useful in applications where the properties of existing hydraulic fluids presents a significant danger due to their flammability. Typical applications for such non-flammable fluids include various civilian and military aircraft, tanks and transport vehicles in which hydraulic systems are subject to damage or failure resulting in leakage and ignition of the fluid.

Existing hydraulic fluids commonly used today in such applications are mineral, naphthenic, or synthetic oils which have been selected primarily on the basis of hydraulic properties without particular regard for non-flammability requirements. In fact, these fluids tend to be highly flammable and cannot be rendered non-flammable by the use of additives or special processing. Typical hydraulic oils which are used extensively in military vehicles are oils designated as MIL-H-6083 and MIL-H-46170.

Among the synthetic oils which have acceptable hydraulic properties, and which are also commercially available, are the chlorotrifluoroethylene-derived oils (hereinafter "CTFE" oils). These oils are essentially non-flammable due to their high degree of halogenation and can thus be used in hydraulic applications where the nonreactivity of the fluid is an essential requirement. CTFE oils are saturated, low molecular weight polymers (i.e. telomers) of chlorotrifluoroethylene, typically having from about 2 to about 10 repeating units in the telomer chain. The terminal groups of the telomer chain are generally derived from the catalyst and/or the solvent used in the telomerization process. The chemical and thermal stability of such CTFE oils is enhanced by fluorination of the terminal groups of the telomer.

A further requirement of hydraulic fluids is compatability with the particular sealing or gasket materials used in the hydraulic system. Sealing materials commonly used in such applications are generally in the form of o-rings fabricated from synthetic elastomers, such as acrylonitrile-butadiene rubber, fluoroelastomers, and the like. Frequently more than one type of elastomer is used in a hydraulic system for a particular piece of equipment. For example, various military hardware currently in use by the U.S. Army employ hydraulic seals fabricated from both acrylonitrile-butadiene rubber, hereinafter "nitrile" rubber, and Viton, a fluoroelastomer based on a copolymer of vinylidene fluoride and hexafluoropropylene manufactured and sold by the E. I. duPont de Nemours & Co., or PNF, a fluorophosphazene fluoroelastomer manufactured and sold by the Firestone Tire and Rubber Co.

In general, the seals for a particular piece of equipment are initially designed and selected on the basis of the specified hydraulic fluid. Thus, as would be expected, conventional hydraulic fluids used in such military hardware, i.e. MIL-H-6083 and MIL-H-46170, are compatible with seals of this type over an operating temperature range of from about −65° F. to about 250° F. However, the CTFE oils, although generally compatible with fluoroelastomers, have been found to be incompatible with nitrile rubber seals due to shrinkage and embrittlement of these seals in a relatively short period of time in the presence of CTFE oils. This shrinkage and embrittlement can result in leakage of fluid from the hydraulic line and failure of the hydraulic circuit. In addition, CTFE oils can extract material from the seal or other components of the system, causing an undesireable build-up of sludge in the hydraulic system. Accordingly, unformulated CTFE oils cannot presently be used in retrofit applications for existing military hardware employing elastomeric seals.

Elastomers employed as seals in hydraulic systems should swell slightly upon contact with the hydraulic fluid to provide a fluidtight seal over the operating temperature range of the equipment. An acceptable range of swelling for purposes of this invention on the basis of percent relative volumetric expansion is generally from about 5% to about 15% over a temperature range of from about −65° F. to about 250° F. Of course, as implied from this statement, any shrinkage of the seal during operation of the hydraulic system cannot be tolerated since this will result in leakage of fluid from the system. Over-expansion of the seal and excessive softening will also lead to leakage of fluid. The fluid should also be capable of dissolving extracted material from seals or other components of the hydraulic system. It is also desireable for the seals to retain the same physical properties, such as tensile and elongation strength, after prolonged exposure to the hydraulic fluid. Therefore, the fluid should contain components which are capable of at least partial replacement of material extracted from the seals. The expression "compatible" as used herein therefore denotes a fluid which satisfies these criteria in a hydraulic system.

Accordingly, it is a primary object of the present invention to provide a non-flammable hydraulic fluid which is compatible with both nitrile rubber seals and fluoroelastomer seals, and suitable for retrofit applications in hydraulic systems employing such seals.

It is a further object of this invention to provide a formulated additive package which, when combined with a fluorinated CTFE oil, will be compatible with a hydraulic system employing nitrile rubber seals and fluoroelastomer seals.

SUMMARY OF THE INVENTION

A non-flammable hydraulic fluid is provided for application in hydraulic systems having nitrile rubber and fluoroelastomer seals. Such non-flammable fluid comprises at least about 75% by volume of a fluorinated chlorotrifluoroethylene oil, an aliphatic ester, a liquid polyether or polyester, a hydrocarbon oil having a low wax content, and a phenolic antioxidant. The aliphatic ester is a swelling agent for the nitrile rubber seals and replaces some of the seal components extracted by the hydraulic fluid. The liquid polyether or polyester replaces additional material extracted from the nitrile rubber seals. The phenolic antioxidant prevents the oxidation of the seal. The hydrocarbon oil is a cosolvent for the other fluid components and also acts as a plasticizer by softening the seals to prevent embrittlement. Preferably, the hydrocarbon oil is present in an amount of from about 5% to about 20% by volume of fluid, the aliphatic ester is present in an amount of from about 1% to 15% by volume of fluid, the liquid polyether or polyester is present in an amount of from about 0.1% to about 10% by volume of fluid, and the phenolic antioxidant is present in an amount of from about 0.001% to about 5% by weight of fluid.

DESCRIPTION OF THE PREFERRED EMBODIMENTS

The non-flammable hydraulic fluid of the present invention comprises a fluorinated CTFE oil, an adipate ester, an aromatic polyether, a phenolic anitoxidant, and a hydrocarbon oil having a low wax content.

The CTFE oil is the major component of the fluid, comprising at least about 75% by volume of the formulated composition. Such CTFE oils can be prepared using a variety of techniques. A fluorinated CTFE oil which is suitable for use in this invention is commercially available from the Occidental Chemical Corporation as Fluorolube® oil.

The fluorinated CTFE oil is inherently non-flammable and is the only non-flammable component of the fluid. In order to preserve the overall non-flammable character of the fluid, and to meet user specifications, it has been found necessary to employ amounts of fluorinated CTFE oil of at least about 75% by volume of the fluid.

An aliphatic ester is incorporated in the fluid as a swelling agent for the nitrile rubber seals in the hydraulic circuit. The primary utility of this component is to prevent shrinkage of the nitrile rubber seals by replacing components of the seal which are extracted by the fluid. Preferred aliphatic esters are adipate esters such as diisodecyl adipate, dioctyl adipate, diisobutyl adipate, di-(2-ethylhexyl) adipate, n-octyl adipate, n-decyl adipate, and oxygenated adipate esters such as di-(butoxyethoxyethoxy-ethyl adipate), dibutoxyethyl adipate, dibutoxyethoxyethyl adipate, dibutoxyadipate, and the like. Mixtures of the foregoing adipate esters can also be used. A particularly suitable adipate ester is Thiokol TP-95, a dibutoxyethoxyethyl adipate manufactured and sold by the Thiokol Chemical Corp. Preferably, the adipate ester is present in an amount of from about 1% to about 15%, and most preferably from about 5% to about 10%, by volume of fluid.

Surprisingly, aromatic esters have not been found to be as effective as aliphatic esters. For instance, phthalates, such as diisodecyl phthalate, contribute to the formulation of a precipitate or sludge in the fluid and should therefore be avoided. Similarly, phosphate esters are not compatible with the nitrile rubber seals and should also be avoided.

A liquid polyether or polyester is incorporated in the fluid to replace additional components extracted from the nitrile rubber seals. The polyethers and polyesters which are suitable for this purpose are those which have molecular weights low enough to be in liquid form at temperatures as low as −65° F. Although both aliphatic and aromatic polyethers and polyesters are generally useful, aromatic polyethers have been found particularly suitabale. Exemplary of such aromatic polyethers is Vulkanol FH, which is manufactured and sold by the Mobay Chemical Corp. Preferably, this component is present in an amount of from about 0.1% to 10%, and most preferably from about 0.5% to 5%, by volume of fluid.

The phenolic antioxidant of the present invention is used to prevent oxidation of the seals. Phenols which are useful for this purpose include various alkylated phenols, hindered phenols and phenol derivatives such as t-butyl hydroquinone, butylated hydroxyanisole, polybutylated bisphenol A, butylated hydroxy toluene, alkylated hydroquinone, 2,6-ditert-butyl-para-cresol, 2,5-ditert-aryl hydroquinone, and the like. A preferred phenolic antioxidant is Irganox L-130, a t-butyl phenol derivative manufactured and sold by the Ciba Geigy Co. Amounts of antioxidant in the range of from about 0.001% to about 5%, and preferably from 0.1% to 1%, by weight of fluid are acceptable. Phosphites can also be used in combination with the aforementioned phenolic antioxidants.

A hydrocarbon oil having a low wax content is needed as a cosolvent for the other components of the fluid and to plasticize and soften the seals. By "low wax content" is generally meant an oil that will not precipitate dissolved impurities at the minimum operating temperature of the fluid, i.e. −65° F. In general, suitable hydrocarbon oils are those which have been thoroughly refined. A typical hydrocarbon oil useful for this purpose is Sun 91 Golden Oil which is a mineral oil manufactured and sold by the Sun Refining & Marketing Co. Amounts of hydrocarbon oil in the range of from 5% to 20% by volume of fluid are generally suitable.

The formulated hydraulic fluid is prepared by blending the various additive components with the base stock fluid, i.e., the fluorinated CTFE oil, until a uniform mixture is obtained with no separation of the components. Alternatively, it is possible to premix the various additives as an additive package prior to blending with the CTFE oil.

Various other additives, such as corrosion inhibitors and lubricity enhancers, can be incorporated in the hydraulic fluid provided that such additives are compatible with the remaining components of the fluid.

The following examples are intended to further illustrate the various embodiments and advantages of the present invention without limiting it thereby. Example 1 illustrates the effect of the formulated hydraulic fluid of this invention on seals fabricated from nitrile rubber and fluoroelastomer materials using a static test to simulate an operational hydraulic system. For comparison purposes, an unformulated material comprising only a fluorinated CTFE oil was tested on equivalent seals.

EXAMPLE 1

O-ring seals were placed in a jar containing sample fluid in a circulating air oven to simulate an actual hydraulic system. The sample fluid formulation contained the following ingredients in relative volumetric proportions except as indicated:

77.5% Fluorolube® Oil
15.0% Sun 91 Golden Oil
5.75% Thiokol TP-95
1.75% Vulkanol FH
0.5% (weight) Irganox L-130

The specific additives are manufacturer's designations which have been previously defined in the specification.

The o-rings were placed in the jar containing the fluid and covered to minimize exposure to air during the test. The oven was heated to 225° F. for 72 hours. The o-rings were removed, dried and tested for hardness (using a Shore Durometer), tensile and elongation strength. The volume change was also measured, and the appearance of the seals was visually observed. The results are set forth in Table I.

In the table, seals A and B designate o-rings fabricated from sulfur-cured nitrile rubber and peroxide-cured nitrile rubber, respectively. Seal C designates an o-ring fabricated from Viton, and seal D designates an o-ring fabricated from PNF. The o-rings were approximately 1.25" in diameter (o.d.).

The original values of the elongation stress of o-rings from the same lot are set forth in parenthesis to the right of the corresponding values obtained after the test.

TABLE 1

| Seal Type | Percent Volume Change | Percent Change in Hardness | Stress @ 100% Elongat-ion (psi) | Percent Retention of Tensile @ Break | Percent Retention of Elongation @ Break | Appearance of Formulation |
|---|---|---|---|---|---|---|
| A | +10.3 | −4.2 | 503 (451) | 80 | 68 | Colloidal solid |
| B | +13.2 | −7.2 | 352 (351) | 84 | 77 | Clear |
| C | +13.4 | −7.7 | 490 (609) | 70 | 97 | Clear |
| D | +9.3 | −8.6 | 551 (517) | 86 | 103 | Slight haze |

As shown in the table, all seals had excellent physical property retention. The seal A test resulted in a small amount of colloidal solids being formed. The seal D test had a slight haze. The remaining two tests, seal B and seal C, showed no haze or solids.

EXAMPLE 2

Following the procedure of Example 1, o-rings were tested for comparison purposes using an unformulated fluid comprising 100% Fluorolube® oil. The results are set forth in Table II using the same format as in Table I. The seal types correspond to those of Example 1.

TABLE II

| Seal Type | Percent Volume Change | Percent Change in Hardness | Stress @ 100% Elongat-ion (psi) | Percent Retention of Tensile @ Break | Percent Retention of Elongation @ Break | Appearance of Formulation |
|---|---|---|---|---|---|---|
| A | −3.04 | +18.5 | 1038 (430) | 90 | 40 | Yellow, cloudy, colloidal solids with a ring at the interface |
| B | −2.7 | +10.1 | 654 (613) | 113 | 114 | Clear, light yellow color |
| C | +11.4 | −5.1 | 608 (696) | 88 | 96 | Clear & water white |

As shown in the table, seals A and B experienced a negative change in volume, i.e. shrinkage, and hardening after testing in the unformulated fluid. The seal A test also resulted in an unsatisfactory formulation appearance indicating the presence of substantial quantities of extracted seal components which were not soluble in the fluid.

While various embodiments and exemplifications of this invention have been shown and described in the specification, modifications and variations thereof will be readily appreciated by those skilled in the art. It is to be understood, therefore, that the appended claims are intended to cover all such modifications and variations which are considered to be within the scope and spirit of the present invention.

What is claimed is:

1. A non-flammable hydraulic fluid which is compatible with both acrylonitrile-butadiene rubber seals and fluoroelastomer seals comprises at least about 75% by volume of a fluorinated chlorotrifluoroethylene oil, from about 5% to about 20% by volume of a hydrocarbon oil having a low wax content, from about 1% to about 15% by volume of an aliphatic adipate ester, from about 0.1% to about 10% by volume of a liquid aromatic polyether, and from about 0.001% to about 5% by weight of a phenolic antioxidant.

2. The hydraulic fluid of claim 1 wherein the aliphatic adipate ester is present in an amount of from about 5% to about 10% by volume of fluid, the liquid aromatic polyether is present in an amount of from about 0.5% to about 5% by volume of fluid, and the phenolic antioxidant is present in an amount of from about 0.1% to about 1% by weight of fluid.

3. The hydraulic fluid of claim 1 wherein the adipate ester is dibutoxyethoxyethyl adipate.

4. The hydraulic fluid of claim 1 wherein the phenolic antioxidant is a t-butyl phenol derivative.

5. The hydraulic fluid of claim 1 which includes a corrosion inhibitor.

6. The hydraulic fluid of claim 1 which includes a lubricity additive.

7. An additive package for use in formulating a non-flammable hydraulic fluid which comprises at least about 75% by total fluid volume of a fluorinated chlorotrifluoroethylene oil, said additive package comprising from about 5% to about 20% by total fluid volume of a hydrocarbon oil having a low wax content, from about 1% to about 15% by total fluid volume of an aliphatic adipate ester, from about 0.1% to about 10% by total fluid volume of a liquid aromatic polyether, and from about 0.001% to about 5% by total fluid volume of a phenolic antioxidant.

* * * * *